US011053940B2

(12) United States Patent
Ott et al.

(10) Patent No.: US 11,053,940 B2
(45) Date of Patent: Jul. 6, 2021

(54) VACUUM PUMP WITH SEPARATE OIL OUTLET WITH RELIEF VALVE

(71) Applicant: Joma-Polytec GmbH, Bodelshausen (DE)

(72) Inventors: Hans-Peter Ott, Hirrlingen (DE); Mathias Schlotterer, Bodelshausen (DE); Torsten Helle, Dusslingen (DE)

(73) Assignee: Joma-Polytec GmbH, Bodelshausen (DE)

( * ) Notice: Subject to any disclaimer, the term of this patent is extended or adjusted under 35 U.S.C. 154(b) by 247 days.

(21) Appl. No.: 16/197,756

(22) Filed: Nov. 21, 2018

(65) Prior Publication Data

US 2019/0170141 A1 Jun. 6, 2019

(30) Foreign Application Priority Data

Dec. 6, 2017 (DE) ..... 10 2017 128 972.0

(51) Int. Cl.
*F04C 18/344* (2006.01)
*F04C 28/28* (2006.01)
*F04C 15/06* (2006.01)

(52) U.S. Cl.
CPC ..... *F04C 18/3441* (2013.01); *F04C 15/064* (2013.01); *F04C 28/28* (2013.01); *F04C 2270/701* (2013.01)

(58) Field of Classification Search
CPC ..... F04C 15/064; F04C 18/3441
See application file for complete search history.

(56) References Cited

U.S. PATENT DOCUMENTS 1,799,902 A * 4/1931 Hoff ..... F23N 5/24 431/121
3,301,474 A * 1/1967 Buchel ..... F04C 27/02 417/310
4,408,968 A * 10/1983 Inagaki ..... F04C 18/3441 418/15
2017/0350391 A1* 12/2017 Tsuda ..... F04C 18/344

FOREIGN PATENT DOCUMENTS

DE 20 28 602 A 1/1971
EP 0 816 682 A1 1/1998

OTHER PUBLICATIONS

German Office Action dated Nov. 23, 2018 in corresponding German patent application No. 10 2017 128 972.0; 7 pages including English-language translation.

* cited by examiner

*Primary Examiner* — Mary Davis
(74) *Attorney, Agent, or Firm* — Maier & Maier, PLLC

(57) ABSTRACT

A vacuum pump having a housing which limits a working space and having a rotor, rotatably mounted in the housing about a rotor axis, the rotor guides a vane being movably mounted in the radial direction, the vane has a transverse extent, and the vane divides the working space into a suction side having a suction inlet and a pressure side having a pressure outlet, the housing has at least one oil outlet, the oil outlet is closed by a relief valve, the relief valve assumes an open position, when a limit pressure lying above a nominal pressure is exceeded in the working space, and the transverse extent of the vane is large enough that when the vane passes the oil outlet, the oil outlet is closed by the vane, so that there is no fluid connection between the suction side and the pressure side over the oil outlet.

10 Claims, 10 Drawing Sheets

VACUUM PUMP WITH SEPARATE OIL OUTLET WITH RELIEF VALVE

FIELD

The invention relates to a vacuum pump having a housing which limits a working space and having a rotor, which is rotatably mounted in the housing about a rotor axis, wherein the rotor guides at least one vane being movably mounted in the radial direction, wherein the vane has a transverse extent, and wherein the vane divides the working space into a suction side having a suction inlet and a pressure side having a pressure outlet.

BACKGROUND

Generally vacuum pumps have a sickle-shaped pump space, which is divided by the at least one vane into pressure chambers. Due to rotation of the rotor, which is eccentric to the wall enclosing, a pressure gradient can be provided between the suction side having a suction inlet and a pressure side with the pressure outlet.

Vacuum pumps are used in many applications, especially in motor vehicles. During operation, vacuum pumps are regularly lubricated with oil. If the combustion engine is cut off, the vacuum pump runs fully off oil, as it is normally located far down on the combustion engine, and thus excess oil runs from the combustion engine into the working space. If the combustion engine is switched on again, the excess oil must be ejected. This is especially critical when the combustion engine has cooled in the meantime and the oil is thus viscous and hard to eject. Such problems occur particularly in hybrid motor vehicles, because a great many "starts" have to be carried out with them.

In a cold start of the vacuum pump with high accelerations, comparatively high torques act on the pump vane. In a cold start however, this results in major problems, as the cooled oil in the working space has a higher viscosity. Thus, in a cold start the pump vane works against the resistance of the cold and in particular highly viscous oil to convey the collected oil out of the work space. In the worst case, a pump vane can break under this load. In order to counteract this, it is known from the prior art to use the largest possible leaf springs at the pressure outlet, which open up a large transverse section and thus reduce the starting torque and the load on the vane or vanes. In addition, the use of ventilation holes lead to permanently increased power consumption.

SUMMARY

The object of the invention is therefore to create a remedy for the named problems of the prior art.

This object is achieved by a vacuum pump with the features of claim 1. It is accordingly provided that the housing has at least one oil outlet different from the pressure outlet, wherein the oil outlet is closed by a relief valve. The relief valve assumes an open position, when a limit pressure lying above a nominal pressure is exceeded in the working space. Furthermore, the transverse extent of the vane is large enough that when the vane passes the oil outlet, the oil outlet is closed by the vane, so that there is no fluid connection between the suction side and the pressure side over the oil outlet.

The nominal pressure is here the operating pressure during normal operation of the vacuum pump. The transverse extent of the pump vane is the extent transverse to the displacement plane of the vane. Because of the oil present in the working space, this nominal pressure is regularly exceeded during a cold start of the vacuum pump. As soon as the pressure is so high that the limit pressure is also exceeded, the relief valve opens so that oil can flow out of the oil outlet. Due to an especially small and fast-reacting relief valve, the highly viscous oil can be quickly discharged from the working space, so that the resistance forces on the vane can be advantageously reduced. And when the vane passes the oil outlet, the latter closes off the oil outlet in order to avoid a "short circuit." Consequently, the suction side cannot communicate via the oil outlet with the pressure side; rather, they are separated from one another. It goes without saying that several oil outlets can also be provided.

In a cold start, pressures of 10 to 15 bar can regularly arise, while the limit pressure can lie at 0.3 to 0.7 bar, in particular at 0.5 bar. This is significantly higher than the nominal pressure.

Thus, all in all, the cold start torque acting on the vane during a cold start can be limited without reducing performance in normal operation. The pump function and its power consumption are thus not negatively impaired.

Here in particular it can be provided that the vane along with the rotor at any rate in the so-called neutral position can be divided into a suction side with a suction inlet, a pressure side with a pressure outlet, and a pump side. The volume of the pump side hereby defines the cubic capacity of the pump. The oil outlet can in particular be provided on the pump side, and thus terminate in the pump side of the working space. In particular, in this way a performance reduction of the pump can be avoided, while oil can be efficiently discharged from the pump during a cold start.

Advantageously the relief valve is made comparatively small and in particular comparatively fast-reacting. Thus a high efficiency can be achieved in the vacuum pump despite the provision of an additional oil outlet additionally to the pressure outlet.

An advantageous further development of the invention provides that at the outlet an outlet valve is provided for opening or closing the outlet, wherein the outlet valve assumes an open position when the nominal pressure in the working space is exceeded, and wherein the nominal pressure is lower than the limit pressure. Thus, the relief valve remains closed in normal operation. Such an outlet valve thus controls normal operation.

A further advantageous embodiment of the invention provides that the oil outlet on the housing is provided in the axial direction. Thus, the vane tip does not move over the oil outlet. Instead, the oil outlet is covered during passage of the vane by the transverse extent of the vane.

It is also advantageous when the housing has a housing cover extending transversely to the rotor axis, wherein the oil outlet is provided in the housing cover. Thus the oil outlet can be covered especially simply by the transverse extent of the vane during passage of the vane.

It is especially preferred when the housing has a pot-shaped housing section having a housing bottom, wherein the oil outlet is provided in the housing bottom. The cylindrical section of the pot-shaped housing section is then configured to be advantageously completely fluid-tight, so that the vane tip can slide thereon, allowing a comparatively high efficiency.

It is also conceivable that both in the housing cover and in the housing bottom, an oil outlet is provided in order to allow especially fast emptying of the working space.

Here it is especially preferred when the oil outlet extends transversely to the rotor axis in the radial direction. In this way especially simple coverage of the oil outlet is possible when the vane passes it, so as to prevent a short circuit.

It is further especially preferred when several oil outlets are provided, wherein the oil outlets can be arranged rotationally-symmetrically around the rotor axis. Here an n-fold rotational symmetry can be present, depending on how many oil outlets are provided. These oil outlets can in particular open sequentially in a cascading manner, as the pressure before the vane reaches the respective oil outlet is regularly the highest, and thus in this region the limit pressure may possibly be exceeded.

Advantageously the oil outlet is configured in the shape of a slot, wherein the slot width is smaller than the vane width. If the slot extends in the radial direction, the slot width is the length of the slot perpendicular to the radial direction.

On the other hand, the oil outlet may also be circular, wherein the opening diameter is smaller than the vane width. Such outlet geometries can be configured especially simply in the housing and can be opened or closed especially quickly by means of a valve.

The transverse length of the vane can be 9 mm, for example. The slot width can be 7 mm, or with a circular design of the oil outlet the diameter can be 7 mm. Thus when the vane passes the oil outlet it can seal the latter.

An especially preferred development of the invention follows from the fact that the relief valve comprises a closing body and a return element, wherein the return element forces the closing body into a closed position in which the oil outlet is sealed.

Such a relief valve closes or opens especially quickly and can be made comparatively small in order to be able to discharge oil from the working space quickly and efficiently without significantly impairing the efficiency in any negative way.

An especially preferred further development of the invention provides that the closing body comprises an elastically pliable locking tongue. Here the locking tongue can be made for example of steel, in particular spring steel, or plastic, and permits quick and precise opening or closing of the relief valve in a simple manner.

Here it is especially preferred when the return element comprises a leaf spring. The leaf spring can in particular be configured as spring-elastic valve and can comprise several leaves. The return element in particular can be secured using a fastening means such as a screw with one end on the pump housing. Such a return element can be produced especially simply and when needed allows fast opening of the relief valve when the limit pressure is exceeded.

Advantageously, the locking tongue is configured from the leaf spring. Such a relief valve is especially simple to produce, so that a reasonably priced yet still effective relief valve is provided.

The outlet valve can also be made of leaf springs. These leaf springs however are significantly weaker than those of the relief valve, so that in normal operation the relief valve is closed, while the outlet valve is open in order to release the pumped medium.

Preferably a stop is provided, which limits the motion of the locking tongue from a closed position to the open position. Accordingly, a precise and efficient opening or closing of the relief valve is allowed.

On the other hand, it is conceivable that the closing body comprises a closing ball. In addition, or alternatively, the return element can be a spring, in particular a screw spring. Such a relief valve especially can be made especially simply and compactly. Furthermore, using the screw spring the oil outlet can also be efficiently closed in such a vacuum pump system, in which gravity does not act in the direction of the closed part of the relief valve. By contrast, a leaf spring in particular can be used when gravity acts on the leaf spring in the direction of the closed position, so that the leaf spring is pressed by gravity against the valve seat.

BRIEF DESCRIPTION OF THE DRAWINGS

Further details and advantageous configurations of the invention may be found in the following description, with reference to which the embodiments of the invention shown in the figures are described and explained in more detail.

DETAILED DESCRIPTION

Figure 1:
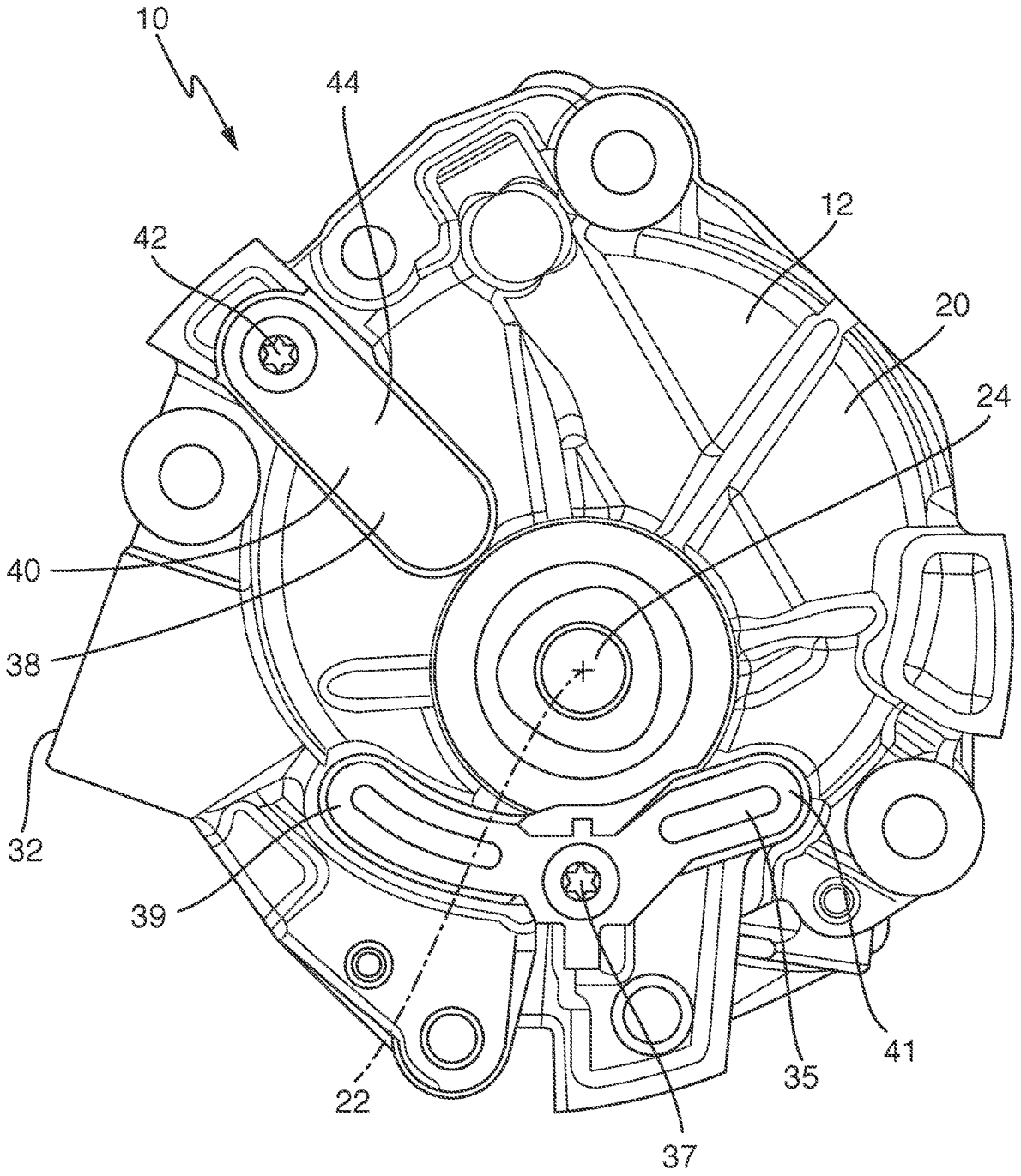
FIG. 1 shows a rear view of a vacuum pump according to a first embodiment.
Figure 2:
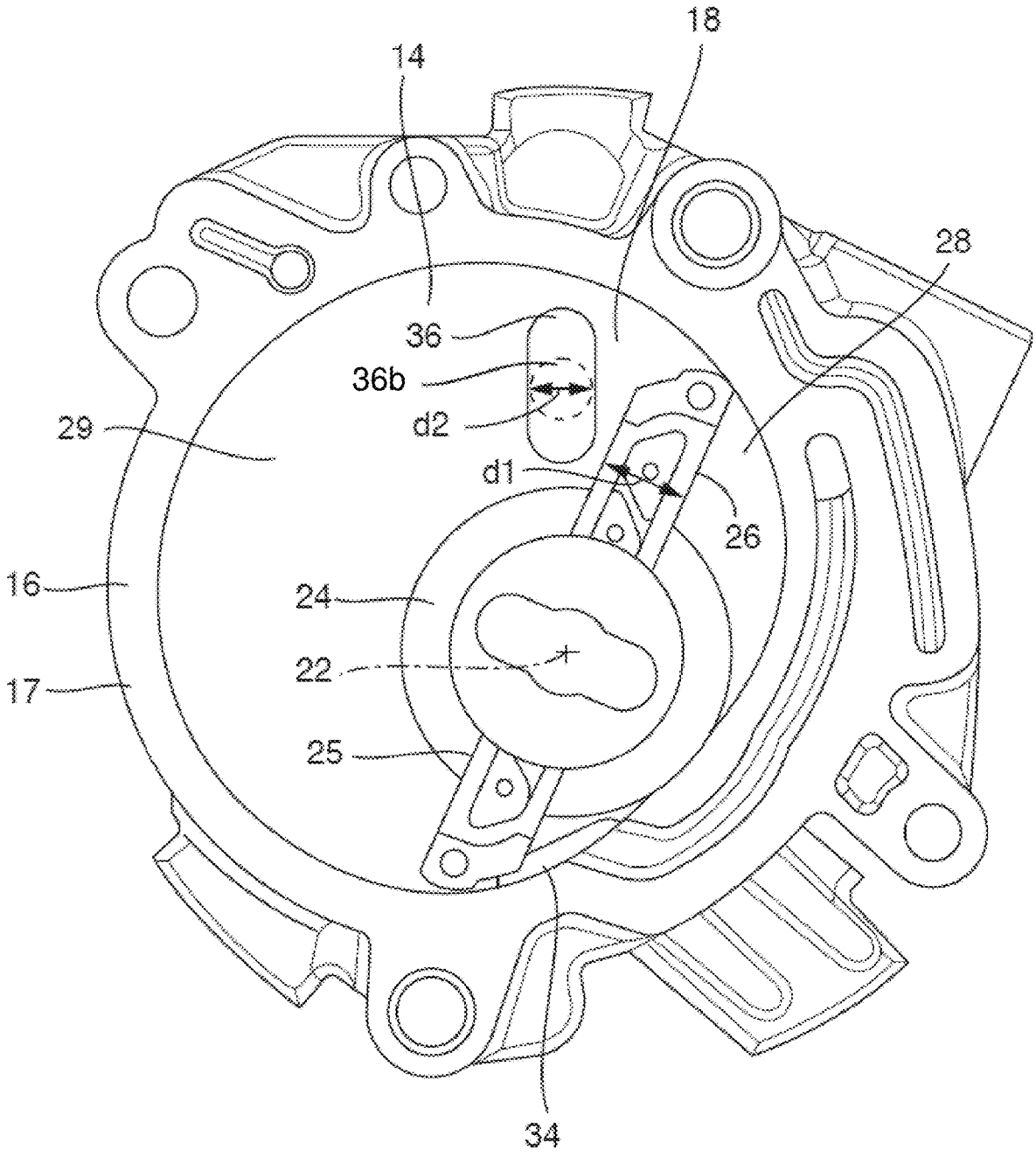
FIG. 2 shows a front view of the vacuum pump according to FIG. 1 with the housing covering removed, in a first vane position which defines the neutral position of the pump.
Figure 3:
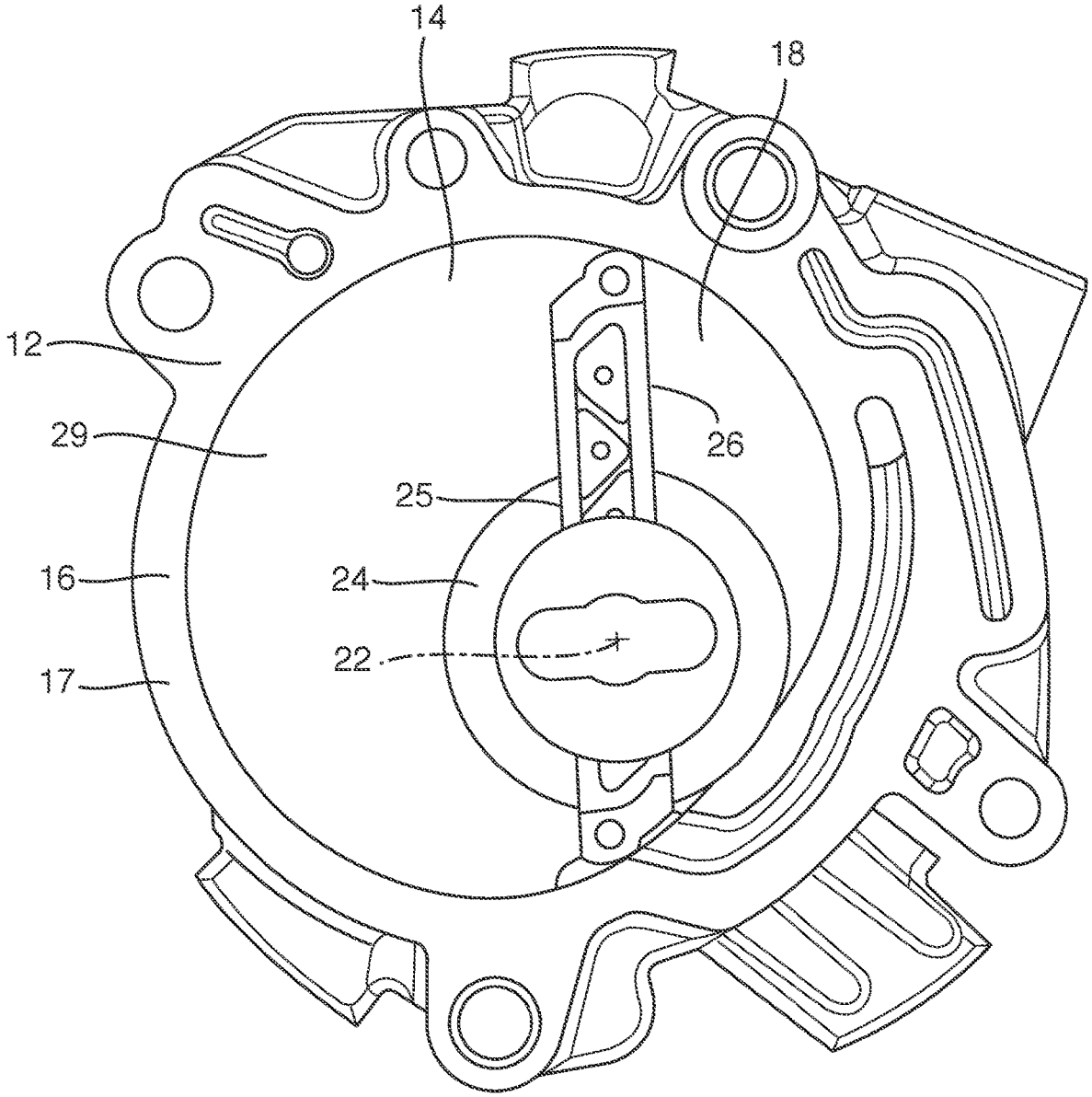
FIG. 3 shows a front view of the vacuum pump according to figure in a second vane position.
Figure 4:
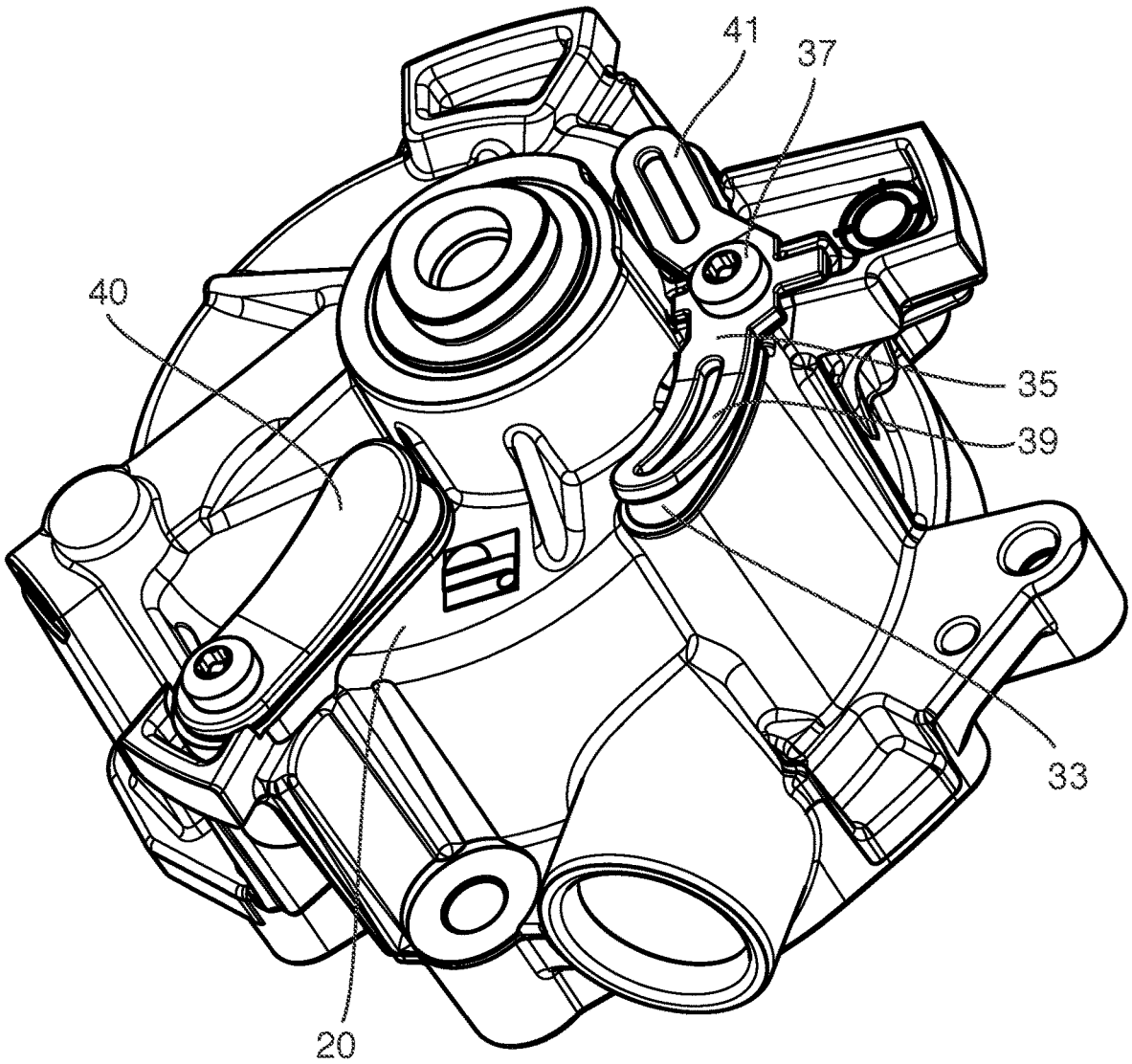
FIG. 4 shows a perspective view of the vacuum pump according to FIG. 1.
Figure 5:
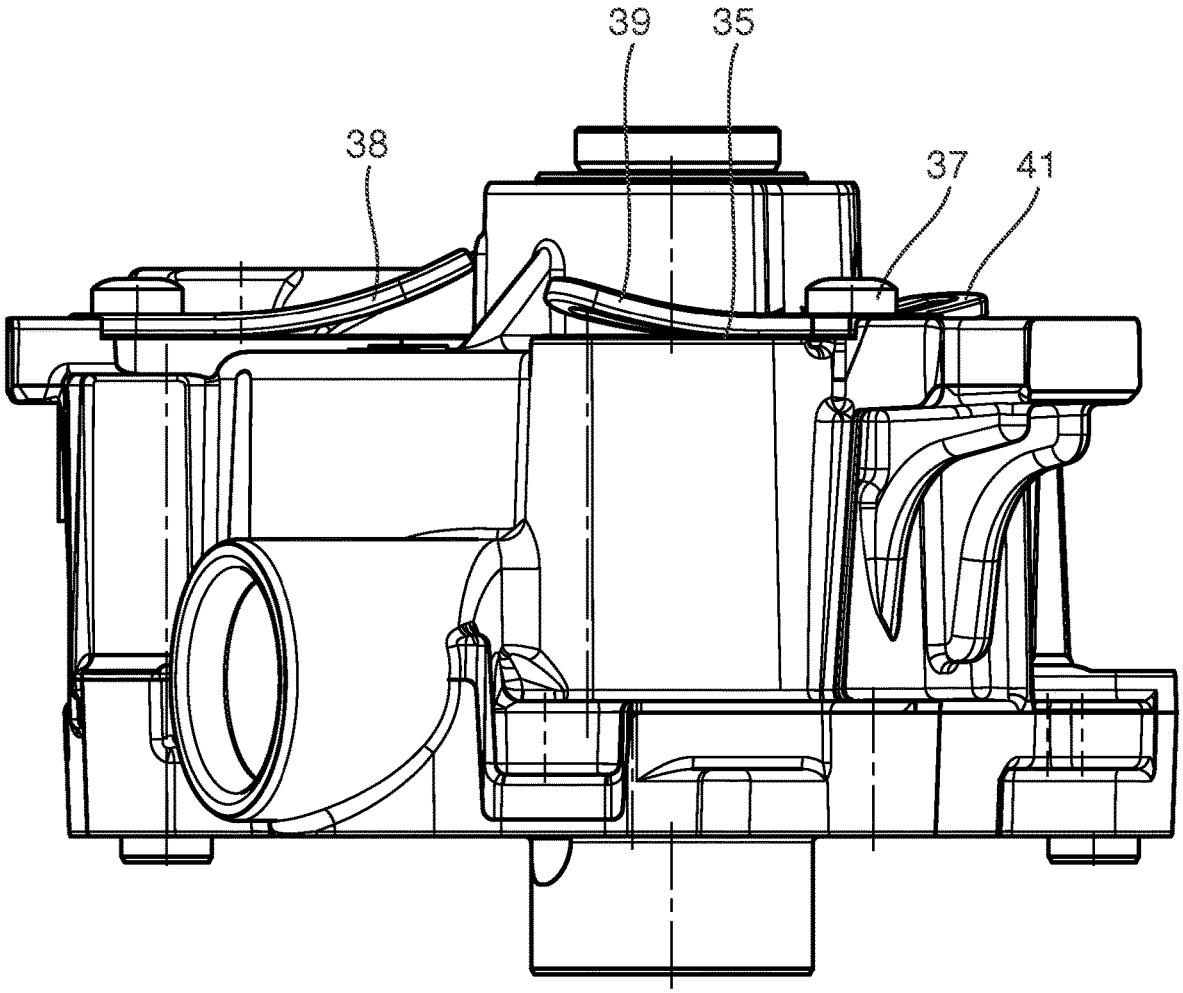
FIG. 5 shows a side view of the vacuum pump at FIG. 1.
Figure 6:
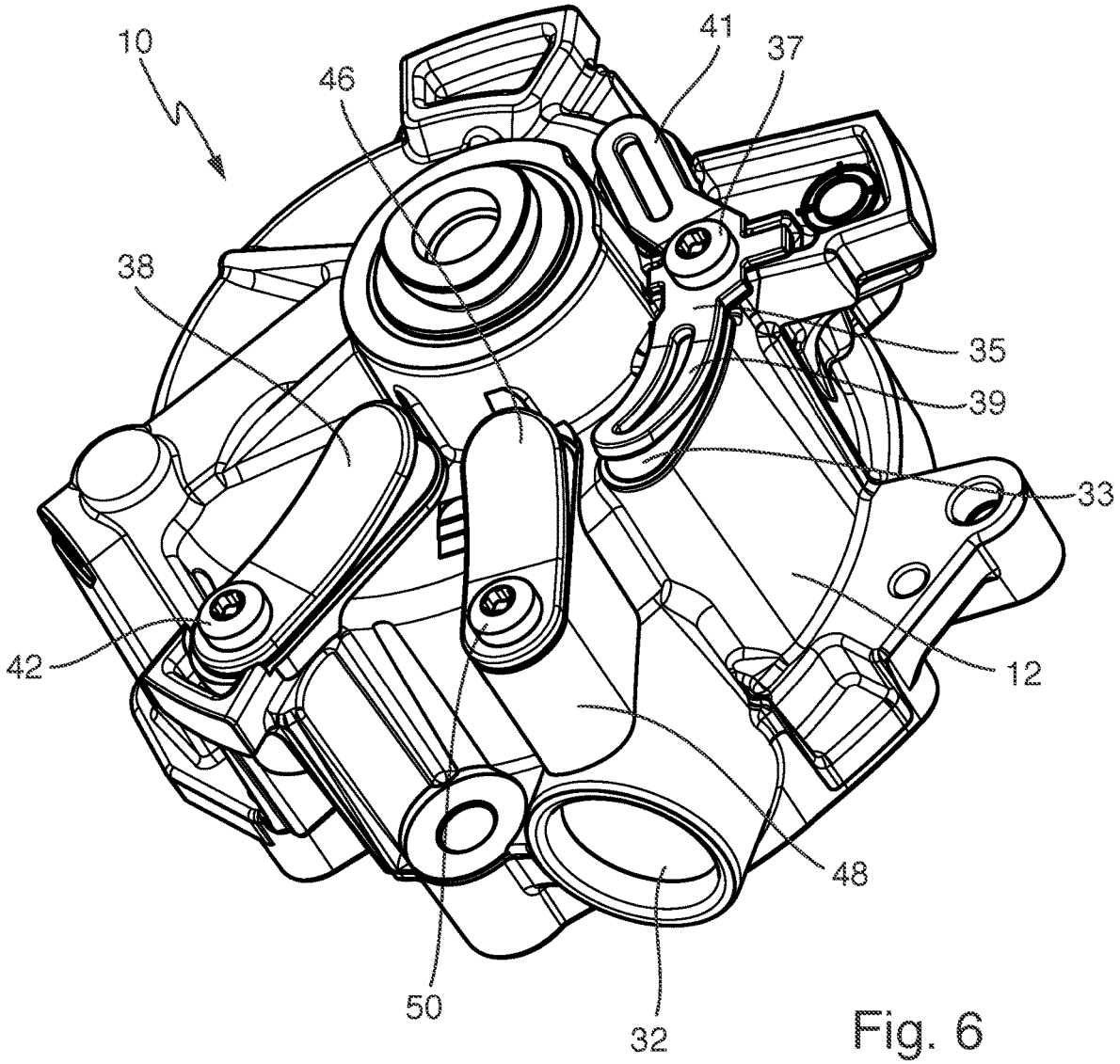
FIG. 6 shows a perspective view of a vacuum pump according to a second embodiment.
Figure 7:
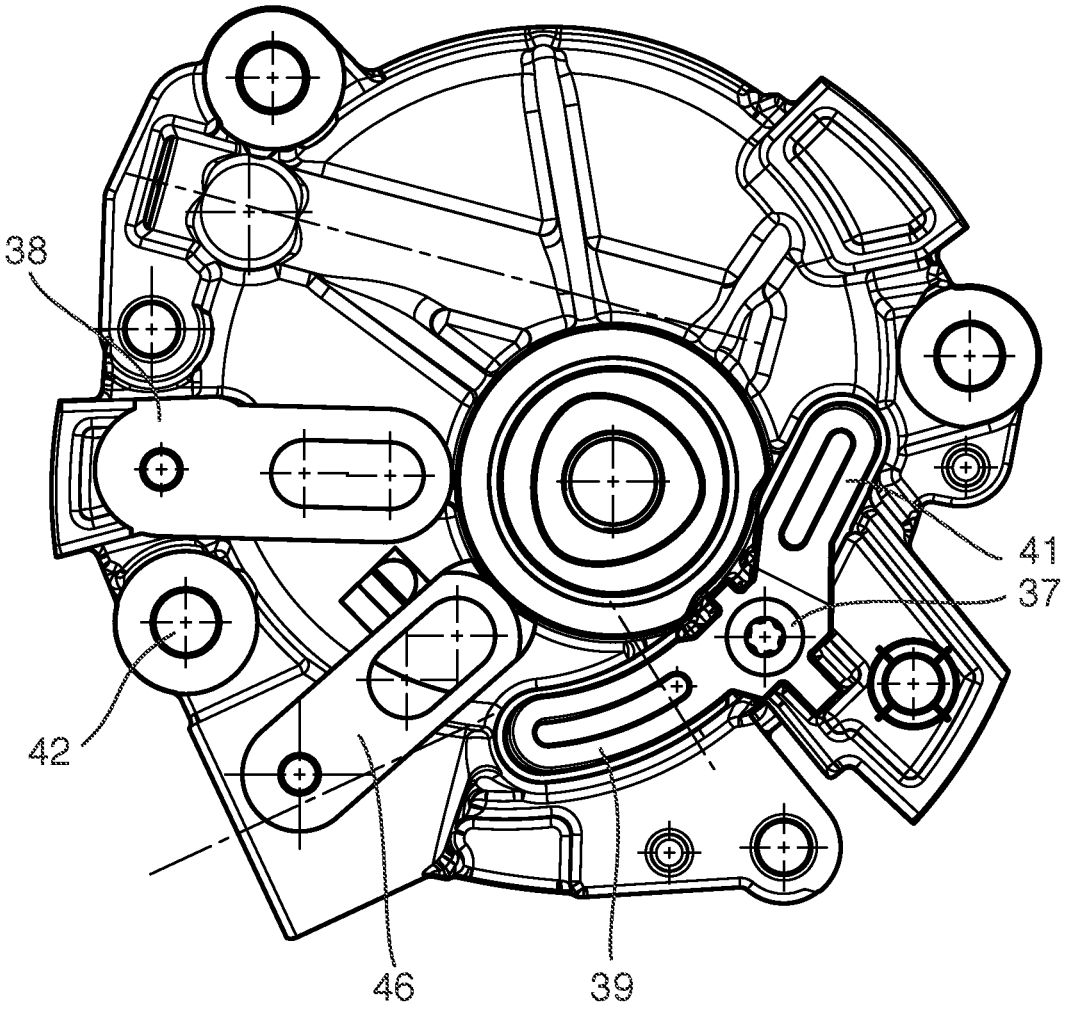
FIG. 7 shows a rear view of the vacuum pump according to FIG. 6.

FIG. 1 shows a vacuum pump 10 having a housing 12 which limits a working space 14 shown in FIGS. 2 and 3. The vacuum pump 10 can in particular be used in a motor vehicle and in particular can be lubricated with oil from the internal combustion engine. The housing 12 is designed in two parts and comprises a pot-shaped housing section 16 with a housing bottom 18, which can be clearly discerned in the FIGS. 2 and 3. Furthermore the housing 12 comprises a housing cover 20, which is visible in FIGS. 1 and 4. In the working space 14, a rotor 24 is provided which is rotatably arranged about a rotor axis 22. The rotor 24 is eccentrically arranged in the working space 14 and lies against the cylindrical section of the pot-shaped housing section 16. The rotor 24 thus assumes an eccentric position in the working space 14. For rotating the rotor 24, it is rotationally coupled by a rotor shaft. The rotor 24 serves for transporting a vane 26 displaceably mounted in the radial direction in a guide 25. In the axial direction, thus in the direction of the rotor axis 22, the working space 14 is limited by a first upper contact surface and a second lower contact surface formed parallel thereto. The upper contact surface is here formed by a housing cover 20, while the lower contact surface is formed by the housing bottom 18.

Figure 8:
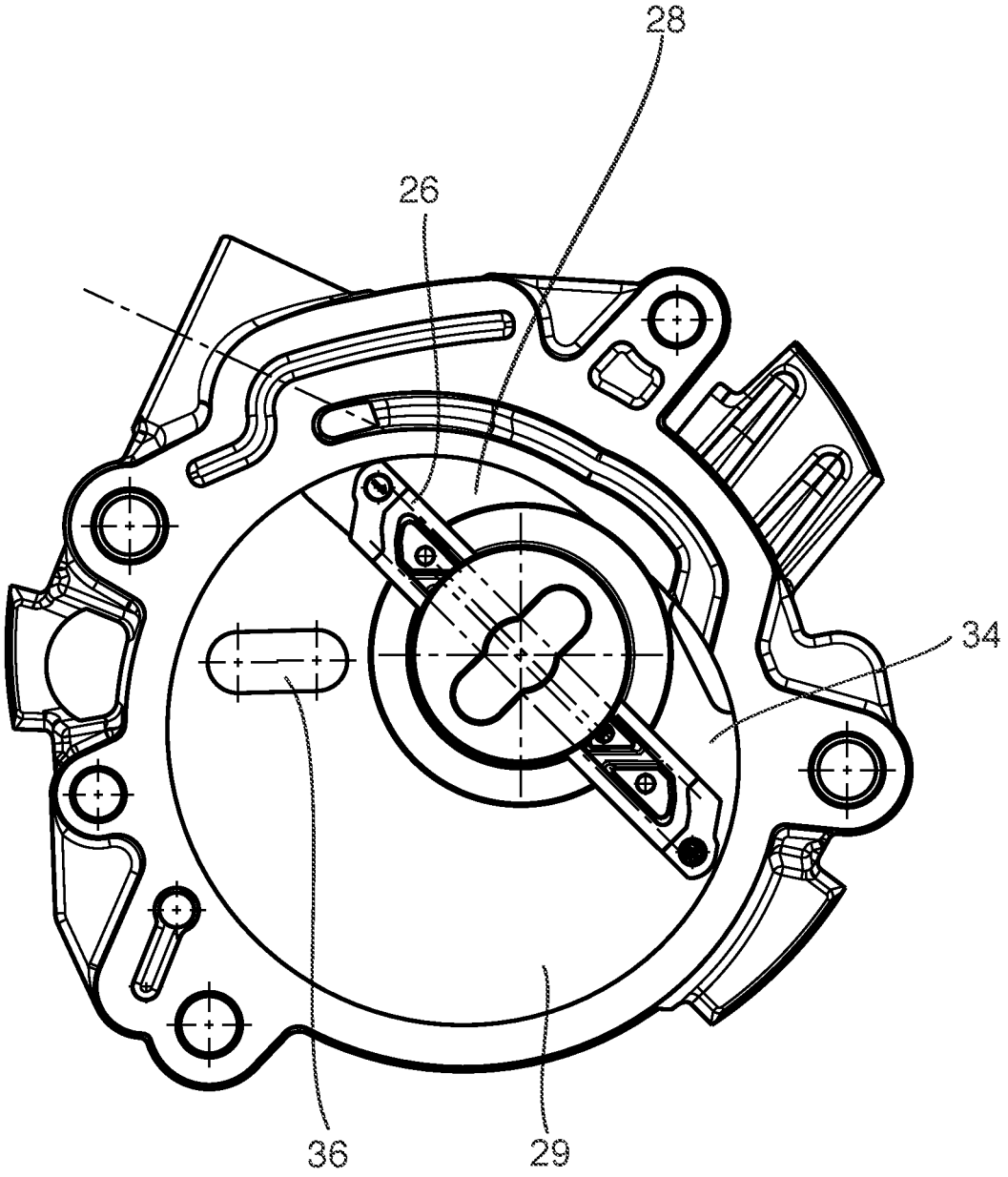
FIG. 8 shows a front view of the vacuum pump according to FIG. 6 in a first vane position.
Figure 9:
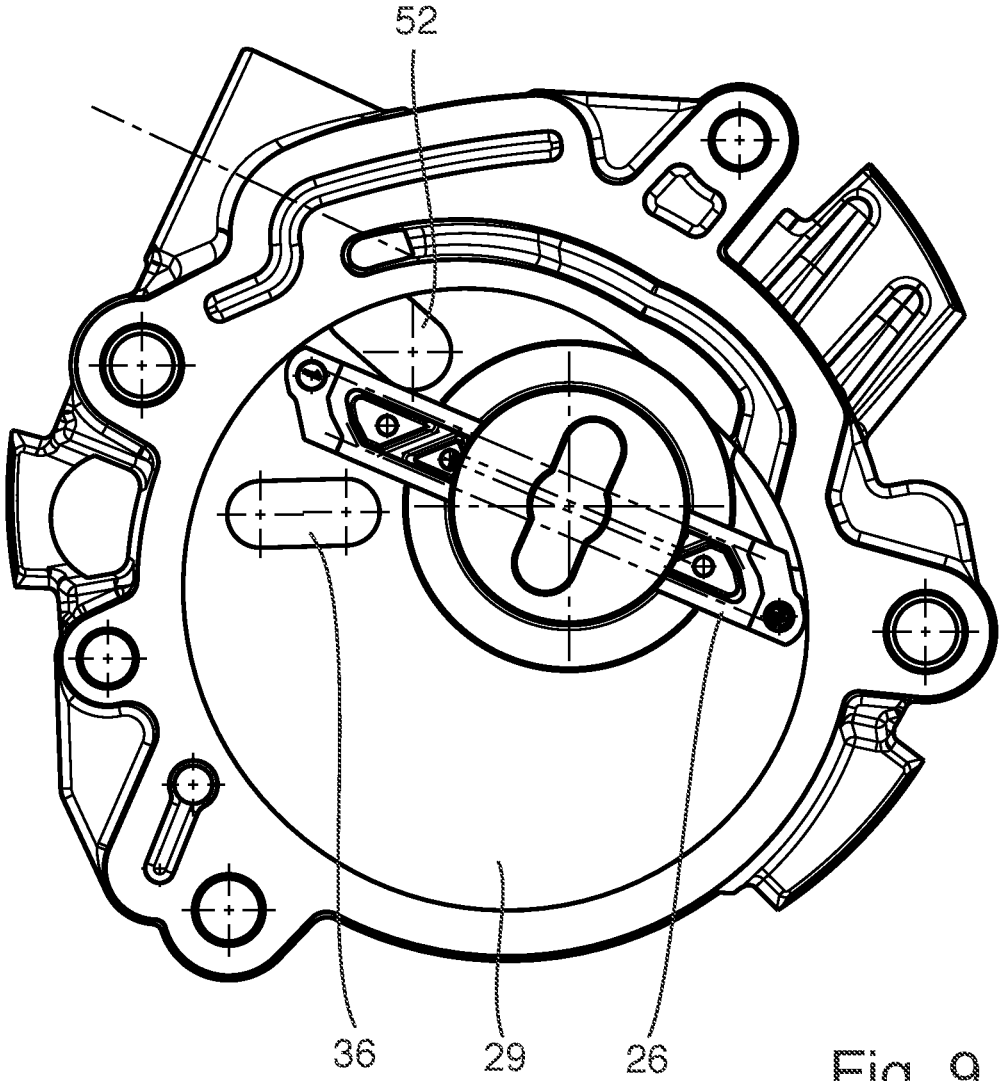
FIG. 9 shows a front view of the vacuum pump according to FIG. 6 in a second vane position.
Figure 10:
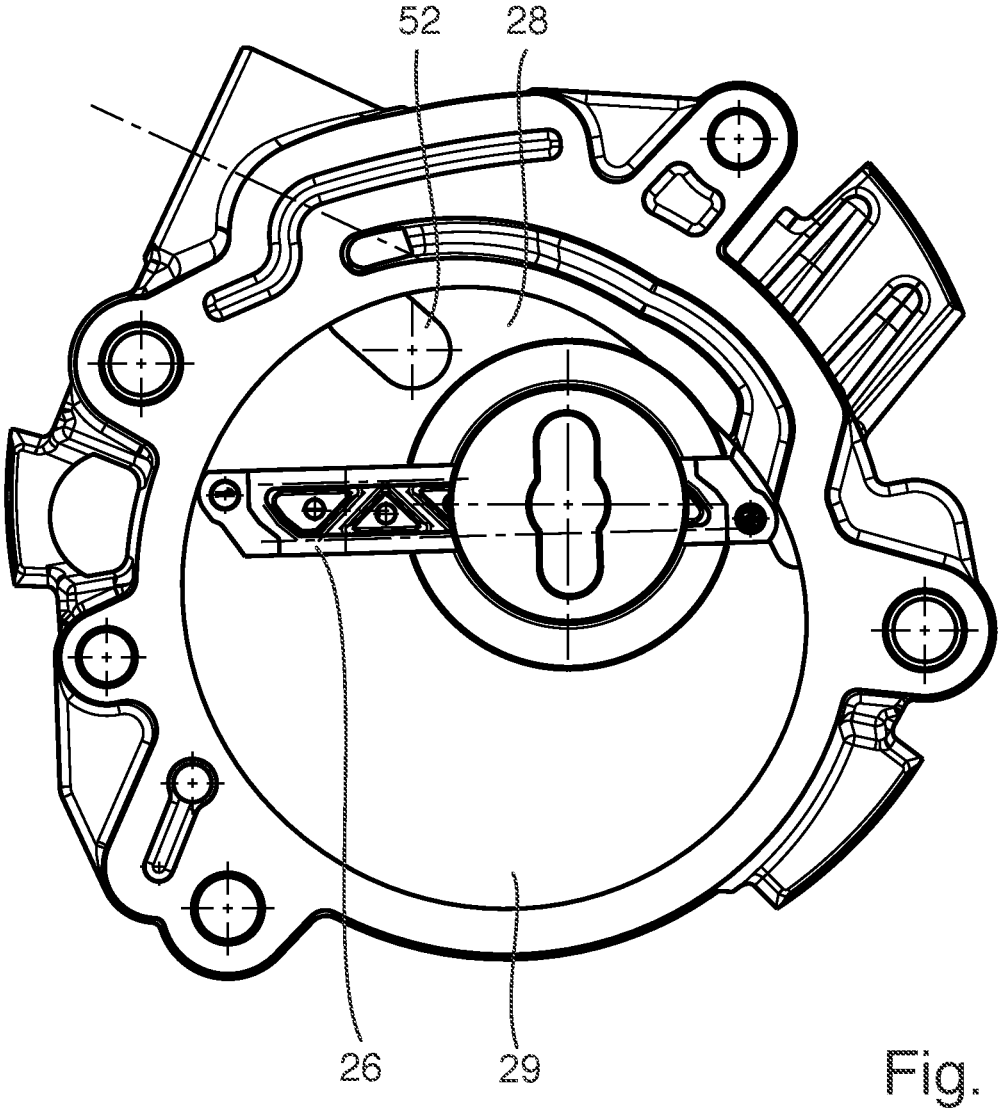
FIG. 10 shows a front view of the vacuum pump according to FIG. 6 in a third vane position.

FIG. 2 shows the so-called neutral position in the vacuum pump 10. The rotor 24 and the vane 26 divide the working space 14 into three sides: The pump 10 comprises first a pressure side 28 and a suction side 34. Further, a pump side 29 is present as the third side. The volume of the pump side 29 defines the cubic capacity of the vacuum pump 10. FIG. 8 shows a similar configuration for the second exemplary embodiment. On rotation of the rotor 24, a pressure gradient arises in the working space 14.

FIG. 1 shows a laterally arranged suction inlet 32. This terminates via the suction side 34 into the working space 14. Furthermore, pressure outlet 33 (cf. FIG. 4) is provided in the housing bottom 18. The pressure outlet 33 extends in the direction of the pressure side 28 in the axial direction through the housing bottom 18 into the working space 14. Thus, on rotation of the rotor 24, fluid is suctioned from the suction inlet 32 and conveyed via the pressure outlet 33 (cf. FIG. 4) out of the pump 10. An outlet is provided in the housing bottom 18 in the pump region 29 additionally to the pressure outlet 33. This outlet is the oil outlet 36 (cf. FIG. 2) having the shape of a slot. The oil outlet 36 may alternatively have a circular shape 36*b*. The oil outlet 36 thus terminates in the pump region 29 of the vacuum pump 10. This has a slotted design and extends in the radial direction with respect to the rotor axis 22. As shown in FIG. 1, the oil outlet 36 is closed by a relief valve 38. The relief valve 38 here comprises a locking tongue 40, which is configured as a leaf spring. This leaf spring is secured by fastening means 42 configured as a screw to the housing 12. The locking tongue 40 can in particular comprise several leaves and can be made of steel. This leaf spring acts simultaneously as a return element 44, so that in the basic position the locking tongue 40 tightly closes the oil outlet 36. A stop can be provided for limiting the motion of the locking tongue 40. For locking the pressure outlet 33, an outlet valve 35 is provided, wherein this outlet valve 35 is opened in normal operation of the vacuum pump 10. The outlet valve 35 is likewise secured by a fastening means 37 configured as a screw to the housing 12. This valve 35 comprises two elastically pliant closing section 39, 41, which can be configured as leaf springs. During operation a nominal pressure predominates in the working space. This nominal pressure is below a limit pressure so that the relief valve 38 is closed and no oil can exit the oil outlet 36. If the closing sections 39, 41 are configured as leaf springs, they are markedly weaker than the leaf springs of the locking tongue 40, so that the outlet valve 35 controls the normal operation, in which the relief valve 40 is closed.

In a cold start of the pump 10, the situation is entirely different from the above. Actually, the pump 10 is lubricated with oil. Residual oil in the working space 14 can be present in the working space 14 during a cold start. Furthermore, oil can be located in the lines and in the internal combustion engine. Since the pump is regularly arranged very far down in a motor vehicle, the pump 10 runs completely full a few seconds after engine cutoff. In a cold start the oil has a high viscosity. Thus, during a cold start of the pump, very high accelerations occur in the vane 26. Thus, a high torque acts on the pump vane, since it works against the force of the oil. Consequently, a pressure arises in the pump 10 which exceeds a limit value. If the limit value is exceeded in the working space, such a high pressure force acts against the return force of the relief valve that the locking tongue 40 lifts off from the valve seat, so that the oil outlet 36 opens. In this way the oil can be discharged from the working space 14. This can occur very quickly. Nonetheless the relief valve 38 can be kept comparatively small, so that the effectiveness of the vacuum pump is comparatively high despite the provision of a second outlet. All in all, therefore, a quick and efficient pressure reduction can occur during a cold start via the oil outlet 36, without negatively impairing the function of the pump 10 and its power consumption.

The vane 26 has a transverse extent d1 (cf. FIG. 2). This transverse extent can be 9 mm, for example. In comparison, the slot-shaped oil outlet 36 has a transverse extent d2 which is smaller than the transverse extent d1, and can be 7 mm, for example. Consequently, if the vane 26 moves via the oil outlet 36, as shown in FIG. 3, at this moment it completely covers the oil outlet 36, and a so-called "short circuit" can be effectively prevented. This means that the pressure space 28 and the suction space 34 are sealed liquid-tight against one another at the oil outlet 36, and no oil can flow via the oil outlet 36 from the pressure side 28 to the suction side 34 and vice versa.

Consequently, all in all a vacuum pump 10 can be provided that limits the cold start torque action on the vane 26 without reducing the performance in normal operation.

FIGS. 6-10 show a second embodiment of the vacuum pump 10. Here a second relief valve 46 is provided next to the first relief valve 38. The housing 12 of the vacuum pump 10 has a protrusion 48, to which the relief valve 46 is secured by means of a screw 50. The relief valve 46 here is identical in construction to the relief valve 38. The second relief valve 38 covers a second oil outlet 52 (cf. FIGS. 9 and 10). This oil outlet 52 likewise has a slotted design and extends in the radial direction with respect to the rotor axis 22. As is clear from FIG. 8, the vane 26 likewise completely covers the oil outlet 52 at the moment when it moves over the oil outlet 52. If the vane, as is visible in FIG. 9, moves further, it passes the region between the oil outlets 36 and 52. The distance between the oil outlets here is greater than the vane width, so that here as well a "short circuit" between the pressure space 28 and the suction space 34 is prevented. By providing a second oil outlet or even several oil outlets, an efficient pressure reduction can be achieved in the working space during a cold start.

The invention claimed is:

1. A vacuum pump, comprising:

a housing which limits a working space, and a rotor, which is rotatably mounted in the housing about a rotor axis, the rotor guides a single vane being movably mounted in a radial direction, the vane has a transverse extent and divides the working space into a suction side having a suction inlet and a pressure side having a pressure outlet, the housing further comprises at least one oil outlet different from the pressure outlet, the at least one oil outlet is closed by a relief valve, which assumes an open position when a limit pressure lying above a nominal pressure is exceeded in the working space, the transverse extent of the vane is large enough that when the vane passes the at least one oil outlet, the at least one oil outlet is closed by the vane, so that there is no fluid connection between the suction side and the pressure side over the at least one oil outlet, the relief valve comprises a closing body and a return element, the return element pushes the closing body into a closed position in which the at least one oil outlet is closed, the closing body and the return element are formed by a leaf spring, and the leaf spring extends transversely to the rotor axis and radially to the rotor axis.

2. The vacuum pump according to claim 1, the rotor and the vane divide the working space in a neutral pump position into a suction side having a suction inlet, a pressure side with a pressure outlet, and a pump side, a volume of the pump side defines a cubic capacity of the pump, and the at least one oil outlet is provided in the region of the pump side and/or the at least one oil outlet terminates in the working space in the region of the pump side.

3. The vacuum pump according to claim 1, at the pressure outlet, an outlet valve is provided for opening or closing the pressure outlet, the outlet valve assumes an open position when a nominal pressure in the working space is exceeded, which is lower than the limit pressure.

4. The vacuum pump according to claim 1, the at least one oil outlet is provided at the housing in an axial direction.

5. The vacuum pump according to claim 1, the housing has a housing cover extending transversely to the rotor axis and the at least one oil outlet is provided in the housing cover.

6. The vacuum pump according to claim 5, the at least one oil outlet extends transversely to the rotor axis in the radial direction.

7. The vacuum pump according to claim 6, wherein a plurality of several oil outlets are provided, and wherein the oil outlets are arranged rotationally symmetrically about the rotor axis.

8. The vacuum pump according to claim 1, the housing has a pot-shaped housing section with a housing bottom and the at least one oil outlet is provided in the housing bottom.

9. The vacuum pump according to claim 1, the at least one oil outlet is configured in a slotted shape and the slot width is smaller than a width of the vane.

10. The vacuum pump according to claim 1, the at least one oil outlet is circular and has an opening diameter smaller than a width of the vane.

* * * * *